US006742915B1

(12) United States Patent
Westerheide

(10) Patent No.: US 6,742,915 B1
(45) Date of Patent: Jun. 1, 2004

(54) LAMP WITH DECORATIVE ELEMENT WHEN ILLUMINATED

(75) Inventor: Jurgen Westerheide, San Juan Capistrano, CA (US)

(73) Assignee: Bruck Lighting Systems, Inc., Costa Mesa, CA (US)

( * ) Notice: Subject to any disclaimer, the term of this patent is extended or adjusted under 35 U.S.C. 154(b) by 0 days.

(21) Appl. No.: 10/428,718

(22) Filed: May 2, 2003

(51) Int. Cl.[7] ..... F21V 1/00

(52) U.S. Cl. ..... 362/360; 362/351; 362/355; 362/311

(58) Field of Search ..... 362/351, 355, 362/360, 361, 311, 363

(56) References Cited

U.S. PATENT DOCUMENTS

| | | | | | |
|---|---|---|---|---|---|
| 1,253,881 | A | * | 1/1918 | Pickhardt | 362/307 |
| 1,274,790 | A | * | 8/1918 | Schnupp | 362/360 |
| 3,119,567 | A | * | 1/1964 | Schwartz | 362/295 |
| 4,254,455 | A | | 3/1981 | Neal, Jr. | 362/296 |
| 4,793,908 | A | | 12/1988 | Scott et al. | 204/192.26 |
| 5,134,554 | A | * | 7/1992 | Donato et al. | 362/226 |
| 5,142,466 | A | * | 8/1992 | Foster et al. | 362/368 |
| 5,975,725 | A | | 11/1999 | Ireland-Stacy | 362/357 |
| D441,484 | S | * | 5/2001 | Nicholas | D26/86 |
| 6,309,084 | B1 | * | 10/2001 | Lin | 362/101 |

* cited by examiner

*Primary Examiner*—Laura K. Tso
(74) *Attorney, Agent, or Firm*—Gene Scott-Patent Law & Venture Group

(57) ABSTRACT

A lamp apparatus includes a pair of concentrically positioned lamp shades and a light source positioned centrally within an inner one of the lamp shades. The lamp shades are bell shaped so as to direct light from the light source downwardly without passing through either one of the lamp shades. The outer one of the lamp shades is formed of a transparent glass or plastic with a thin film optical coating of randomly variable thickness on its inner surface. The inner one of the lamp shades is formed of a translucent glass or plastic. Standard lamp hardware is used to assembly the apparatus into a functional lamp assembly. When the light source is not illuminated, the outer shade appears as a metallic or chrome color, and when it is illuminated, the outer shade appears transparent and the inner shade appears to have a rainbow colored effect. Downward directed light is not colored.

11 Claims, 1 Drawing Sheet

LAMP WITH DECORATIVE ELEMENT WHEN ILLUMINATED

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to electric lamps and decorative shades therefor, and more particularly to a double lamp shade with a dichroic coating presenting unusual visual effects when illuminated.

2. Background and Description of Related Art

With respect to lamp shades used for covering a light source, except for opaque shades, such shades generally change their appearance when the light source is illuminated. Most generally, translucent shades become illuminated from the light source and present a desired appearance. Transparent shades transmit light from the source directly but also may present a novel appearance with certain parts of the shade being illuminated in desired ways.

It is known to use colored lights in combination to produce various color displays on a translucent shade. Two-piece lamp shades having an inner shade and an outer shade are known to be used to produce interesting effects as in the Ireland-Stacy reference described below.

It is known to use optical thin films of transparent and semi-transparent materials having thicknesses approximating one-fourth the wavelength of the light that it is desired to transmit through the films, in multiple layers, in order to fabricate optical filters. Such filters may be designed to pass selected wavelength bands of light energy while rejecting others. When the optical filters are held to a desired thickness uniformly across a workpiece, a uniform effect is produced, that is, the visual effect is that certain colors of light appear to the observer. When the thicknesses of the optical films are allowed to vary across the workpiece, the visual effect is that the colors produced vary from point to point over the workpiece. Such a film may be deposited that will produce a rainbow effect. This phenomenon is used in the present invention.

The following art defines the present state of this field:

Neal, Jr., U.S. Pat. No. 4,254,455 describes a reflector for use in a dental, medical or other lighting device wherein light from a light source is reflected thereby in a predetermined pattern for illumination of a desired zone. The reflector is formed of a glass substrate of predetermined shape and has a dichroic coating on the front surface for reflecting a substantial portion of visible light and for allowing infrared and other undesirable energy along with some unreflected visible light to pass therethrough so that cool light only is reflected and a diffuser coating on the rear surface for diffusing light passing through the glass substrate to reduce undesirable glare from the rear of the reflector. The diffuser coating is preferably a ceramic frit.

Ireland-Stacy, U.S. Pat. No. 5,975,725 describes a shade for covering a light source and a process for making the shade. The shade comprises an inner member and an outer member where the outer member is connected to the inner member. At least one inclusion is located between the inner member and the outer member wherein covering the light source with the shade enables viewing of the inclusion therein when the light source is in an on state and substantially prohibits viewing of the inclusion therein when the light source is in an off state.

Scott, et al; U.S. Pat. No. 4,793,908 describes a method of fabricating multiple layer, solid, thin films on a substrate having a surface to be coated, the method providing control over the thickness, stoichiometry, and morphology of each separate layer formed by a method comprising the steps of: A. forming a first ion beam from an inert gas; B, bombarding a target surface with said first ion beam in a vacuum chamber to generate a vapor cloud composed of the target material atoms by the process of sputtering; C. adjusting the respective positions of the substrate surface for coating and the target surface to promote the condensation of the vapor upon the substrate surface for coating; D. forming a second ion beam, the second ion beam's ions being formed from a mixture of inert and reactive gases; E. bombarding the substrate surface simultaneously with the second ion beam to promote a chemical reaction between the target vapor atoms and the chemically reactive gas ions as the target atoms and the chemically reactive gas ions impinge upon the substrate surface for coating, the resulting chemical compound building up in thickness as a homogeneous thin solid film layer; F. positioning an alternative target material in the place occupied by the previous one; G. repeating the above method steps to produce each successive thin solid film layer of different material formed upon each previous layer.

The prior art teaches the concept of using an inner and an outer lamp members to present the effect of viewing an inclusion only when the lamp is illuminated, but not otherwise. The prior art also teaches the use of thin film coatings in a lamp to enable only certain visible portions of light to pass while reflecting others. However, the prior art does not teach the use of a multi-layer thin optical film coating of a lamp shade for producing a rainbow visual effect when a lamp is illuminated, but not otherwise. The present invention fulfills these needs and provides further related advantages as described in the following summary.

SUMMARY OF THE INVENTION

The present invention teaches certain benefits in construction and use which give rise to the objectives described below.

The present invention comprises a lamp assembly having a shade system covering a light source. The shade system includes an outer shade envelope made of a transparent material such as glass or plastic. This outer shade envelope is treated with a multilayer optical coating on its in-facing surface. An inner shade envelope is positioned within the outer shade, and this shade is made of translucent material, again generally frosted glass or plastic. The shades are mounted concentrically. A light source such as an electric lamp is positioned at the center of the inner shade envelope. The invention presents three different appearances to a viewer. Viewing the lamp assembly from one side, when the lamp is not illuminated, the inner shade is not visible, and only the outer shade envelope may be seen, and it appears to be a gray metallic color. From this same viewpoint, when the lamp is illuminated, the outer shade appears to be transparent while the inner shade, appears to have a multicolored pattern such as a rainbow. In an alternate embodiment, the inner shade may be constructed of two individual envelopes joined integrally. The light directed downwardly, as for illuminating a restaurant table, does not have the various colors seen from the side of the outer shade but rather is the color of light produced by the electric lamp.

A primary objective of the present invention, is to provide an apparatus and method of use of such apparatus that provides advantages not taught by the prior art.

Another objective is to provide such an invention capable of producing an interesting visual effect on the shade when seen from one side, while producing a conventional illumination below.

A further objective is to provide such an invention capable of having the interesting visual effect only when the interior lamp is illuminated but not otherwise.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
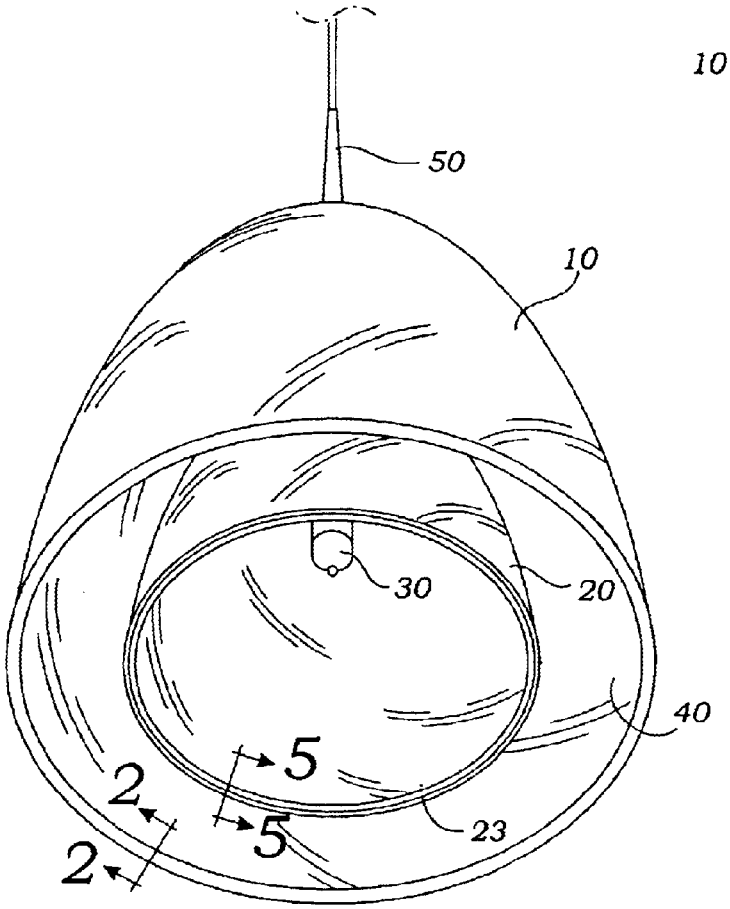
FIG. 1 is a perspective view of a preferred embodiment of the invention.
Figure 2:
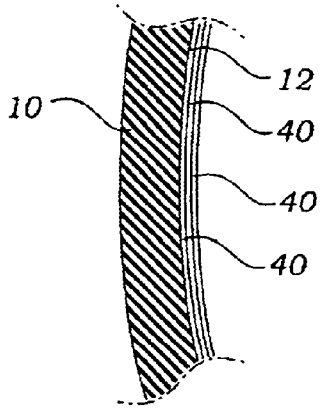
FIG. 2 is sectional view taken along line 2—2 in FIG. 1.

The present invention is a lamp apparatus comprising a pair of concentrically positioned lamp shades 10, 20 and a light source 30 as illustrated in FIG. 1. The light source 30 is preferably one or more electric lamps and is preferably positioned centrally within an inner one 20 of the lamp shades. The lamp shades 10, 20 are preferably bell shaped for directing light from the light source downwardly without passing through either one of the lamp shades 10, 20. The outer one 10 of the lamp shades 10, 20 is formed of a transparent rigid material, preferably glass or plastic, with a thin film optical coating 40 of randomly variable thickness deposited on its in-facing surface 12. Such a thin film optical coating 40 is well known in the field of optics and its application may be accomplished by the well known technique of flash evaporation of an optical film compound such as titanium dioxide, and silicon oxide in thicknesses of between 500 to 800 Angstroms thick for each of from 9 to 25 layers, see FIG. 2. The source for such an evaporation may be ideally considered as a point source so that when it is located below a bell-shaped surface, as in the present invention, the thickness of the layer projected upward into the shade various from point to point. If the evaporation source is placed off-center with respect to the shade's axis, the thickness distribution is even more uneven. Sputter-deposition technique may be used for the preparation of these optical layers also and layer thickness distributions can be quite non-uniform in this case as well. Because a stack of optical layers acts as a filter to white light, preferentially allowing certain wave bands of light to pass more easily then others, it is possible to place a small number of such optical layers to achieve a rainbow visual effect when the layers are purposely deposited non-uniformly with respect to layer thickness. In the present invention, five ¼ wavelength layers centered on 550 nanometers presents a visual appearance similar to a rainbow when the layer thicknesses vary by up to ±50%.

The inner one 20 of the lamp shades 10, 20 is formed of a translucent rigid material, again, preferably glass or plastic. Conventional lamp hardware 50 engages the lamp shades 10, 20 and light source 30 for maintaining fixed mutual positions thereof as a lamp assembly including mounts for the lamp shades 10 and 20, one or more sockets for the light source 30, which may be one or more electric light bulbs, and a switch for turning the light source on and off. Assembly of such a lamp appliance is well known in the field of this art.

Figure 3:
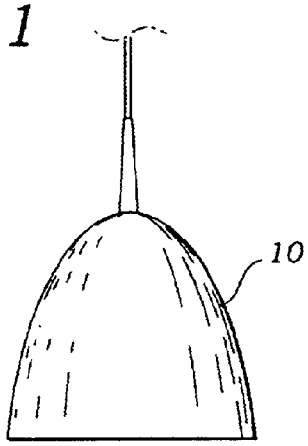
FIG. 3 is an elevational view thereof showing the appearance of the invention when a light source of the invention is not illuminated.
Figure 4:
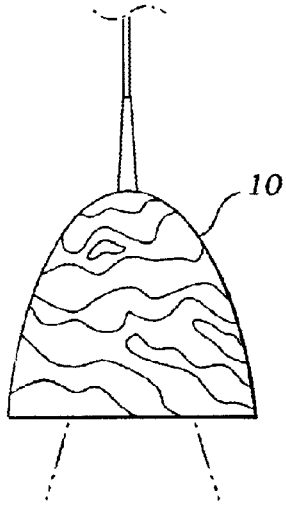
FIG. 4 is the same elevational view as in FIG. 3, showing an approximate appearance of the invention when the light source is illuminated.

FIGS. 3 and 4 depict the appearance of the present invention as viewed from one side when the light source is not illuminated (FIG. 3), and when it is illuminated (FIG. 4), although FIG. 4 must be shown in color to appreciate the rainbow of colors that are visible to the observer.

Figure 5:
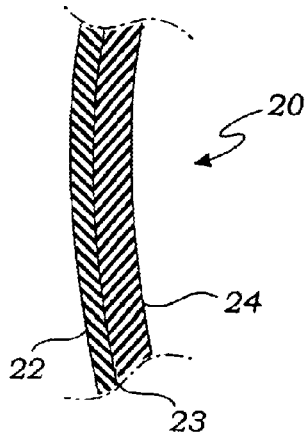
FIG. 5 is a sectional view taken along line 5—5 in FIG. 1.

In a further embodiment of the present invention, the inner one of the lamp shades 20 is comprised of two individual glass or plastic shade portions 22 and 24, integrally engaged and nested together. Please see the cross section shown in FIG. 5. It has been found that the interface 23 between the two layers 22, 24 is functional in producing a more complex color pattern. This occurs because light from the light source 30 is diffracted at the interface 23 which acts to spread out the individual light wavelengths, although to a much less extent than is possible with a prism. When the index of refraction of each of the two shade portions 22 and 24 are significantly different, as is possible by using different materials for each, the visual effect is more pronounced.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A lamp apparatus comprising: a pair of concentrically positioned lamp shades and a light source positioned centrally within an inner one of the lamp shades, the lamp shades configured for directing light from the light source downwardly without passing through either one of the lamp shades; an outer one of the lamp shades formed of a transparent rigid material with a non-uniformly thick thin film optical coating of randomly variable thickness thereon; the inner one of the lamp shades formed of a translucent rigid material; and a lamp hardware engaged with the lamp shades and light source for maintaining fixed mutual positions thereof.

2. The apparatus of claim 1 wherein the thin film optical coating is applied to an in-facing surface of the outer one of the lamp shades.

3. The apparatus of claim 1 wherein the lamp shades are made of one of glass and plastic.

4. The apparatus of claim 1 wherein the lamp shades are bell shaped.

5. The apparatus of claim 1 wherein the inner one of the lamp shades is comprised of two individual shade portions integrally abutted.

6. The apparatus of claim 5 wherein the two individual shade portions are comprised of materials having different indexes of refraction.

7. The apparatus of claim 1 wherein the thin film optical coating comprises plural layers of optical materials.

8. The apparatus of claim 7 wherein the optical materials are oxides.

9. The apparatus of claim 8 wherein the oxides include titanium dioxide and silicon oxide.

10. The apparatus of claim 1 wherein the thin film optical coating is deposited using flash evaporation of optical compounds.

11. The apparatus of claim 1 wherein the thin film optical coating is deposited using physical sputtering of optical compounds.

* * * * *